US006009671A

United States Patent [19]

Sasaki et al.

[11] Patent Number: 6,009,671

[45] Date of Patent: Jan. 4, 2000

[54] SYSTEM FOR AUTOMATICALLY OPENING OR CLOSING FOR VEHICLE

[75] Inventors: Satoru Sasaki, Kasakake-machi; Masaei Sato, Ashikaga; Takayuki Kusaka, Kiryu, all of Japan

[73] Assignees: Mitsuba Corporation, Gunma; Honda Giken Kogyo Kabushiki Kaisha, Tokyo, both of Japan

[21] Appl. No.: 08/953,298

[22] Filed: Oct. 17, 1997

[30] Foreign Application Priority Data

Oct. 25, 1996 [JP] Japan ..... 8-284358

[51] Int. Cl.[7] ..... E05F 11/48

[52] U.S. Cl. ..... 49/352; 49/360; 296/146.1

[58] Field of Search ..... 49/360, 352, 348, 49/26, 28; 296/146.1, 155; 318/466; 123/198 R; 242/390.9, 413.6

[56] References Cited

U.S. PATENT DOCUMENTS 5,063,897 11/1991 Okui et al. ..... 123/198 R
5,644,869 7/1997 Buchanan, Jr. ..... 49/362
5,708,338 1/1998 Cook et al. ..... 318/466
5,737,875 4/1998 Dowling et al. ..... 49/360
5,793,173 8/1998 Henschel et al. ..... 318/466 X
5,833,301 11/1998 Watanabe et al. ..... 49/360 X

*Primary Examiner*—David M. Purol
*Assistant Examiner*—Hugh B. Thompson
*Attorney, Agent, or Firm*—McCormick, Paulding & Huber LLP

[57] ABSTRACT

In a system for automatically opening or closing a sliding door or the like for a vehicle, an undesired clamping of an object between the door and the vehicle body, resulting in increased tension force in the wire moving the door, is sent early and relieved quickly. The wire (4) is solidly secured to the sliding door and wound onto a drum (10) to open or close the door by a motor driving the drum, and two tensioners (11*a* and 11*b*) are provided respectively on opposite sides of the drum and between the drum and door. Each sensor has a movable part (19) positioned in accordance with the tension force in the wire passing through the tensioner, sensor plates (20) are provided on the movable parts of the tensioners, and magnetic sensors (21) are provided to detect the moving speeds of the plates. When the moving speeds of the plates are larger than a predetermined value, preset in advance, in cases other than when the door is at a fully closed or fully opened condition, a controller concludes that some object has been clamped between the door and the vehicle body and immediately relieves such clamping.

8 Claims, 11 Drawing Sheets

*(PRIOR ART)*

*(PRIOR ART)*

*(PRIOR ART)*

SYSTEM FOR AUTOMATICALLY OPENING OR CLOSING FOR VEHICLE

BACKGROUND OF THE INVENTION

1. Field of the Invention

This invention relates to a system for automatically opening or closing a slide-type opening-closing section provided on a vehicle, and more particularly to a technique effective for being applied to a slide-type door (hereinafter referred to as a "slide door") provided on a side portion of a wagon car, one-box car and the like.

2. Statement of the Related Art

In vehicles such as motor cars, there has heretofore been provided an opening-closing section everywhere in a sliding manner such as a window, a sun-roof, a door and the like. Particularly, in the vehicles such as wagon cars and one-box cars, there are often found ones with which a slide door being provided on the side portion thereof to get on and off, and to load and unload easily. However, with this slide door, although a relatively large opening can be secured without taking a space for opening or closing the door, the slide door tends to be large and opening or closing of the door is liable to be heavy. For this, there have heretofore been cases where it is difficult for women and children to easily open or close the door. In particular, there have been such problems that, when the vehicles stop on a sloping road, it is difficult to open the door or the door is closed abruptly. Then, under the circumstance where one-box cars and the like are increased for family use, there is a trend that there are introduced vehicles equipped with systems for automatically opening or closing a slide door, in which women and children can easily open or close the door, and the number of such cars is increasing. Furthermore, if the system for automatically opening or closing the door is provided, then, the slide door can be remote-controlled even when a hand cannot reach from a driver's seat, so that there are quite a few request for mounting the automatic opening-closing system from this viewpoint of handiness.

The above-described system for automatically opening or closing the door has a construction as shown in FIG. 8 in general. A slide door 1 is provided on one side of a vehicle body 2 and moved in the longitudinal direction of the vehicle body 2 to be opened or closed. In this case, the slide door 1 is secured to a wire 4 through a center roller assembly 3, whereby the slide door 1 is operated to open or close by this wire 4. Furthermore, the vehicle body 2 is provided thereon with a slide rail 5, whereby the center roller assembly 3 is guided and moved by the slide rail 5. A curved portion 5*a* is formed on the front side of the slide rail 5 and the center roller assembly 3 is guided by this curved portion 5*a*, whereby the slide door 1 is closed in a state of being flush with the side surface of the vehicle body 2 as indicated by one-dot chain lines.

On the other hand, the wire 4 is guided by a slide actuator 7 through a pulley assembly 6*a* and 6*b*. FIG. 9 shows the outline of construction of this slide actuator 7. The wire 4 is wound by a drum 10 which is driven by a motor 9. In this case, by the rotating direction of the drum 10, it is determined that which side of the wire 4 is wound, whereby the moving direction of the slide door 1 is determined. Then, along with the driving of the drum 10, the slide door 1 is guided by the slide rail 5 and moved thereon while the slide door 1 is pulled by the wire 4. The slide actuator 7 is controlled by a control unit 8 as being a control means incorporated therein with a computer and the like, and controls of the countering to a clamping and the like, which will be described hereunder, are performed by this control unit 8. Furthermore, transmission of a driving force from the motor 9 to the drum 10 is performed through gears 14*a* to 14*d*.

Next, tensioners 11*a* and 11*b* are provided on a former stage of the drum 10, whereby looseness of the wire 4 is removed to maintain the tensile force thereof within a predetermined range all the time. In this case, the tensioners 11*a* and 11*b* are provided with fixed pulleys 18*a*, 18*b* and moving pulleys 12*a*, 12*b*. The wire 4 starts from the fixed pulleys 18*a* and 18*b*, and it is guided around the moving pulleys 12*a* and 12*b*, and thereafter, wound by the drum 10. Furthermore, the tensioners 11*a* and 11*b* are energized by tension springs 13*a* and 13*b* in a direction for lengthening a path, in which the wire 4 is drawn around. With this arrangement, when the tensile force of the wire 4 is loosened, the moving pulleys 12*a* and 12*b* are automatically moved in the direction for lengthening the path of the wire 4, whereby the looseness of the wire 4 is removed, so that a predetermined tensile force can be maintained. Accordingly, the looseness of the wire 4 occurring immediately after the operation of the drum 10 and the looseness due to the load fluctuations, which occurs when the center roller assembly 3 enters the curved portion 5*a* of the slide rail 5, are absorbed by the movement of the moving pulleys 12*a* and 12*b*.

Now, in the system for automatically opening or closing the slide door, in order to protect crew members, there is required a safety countermeasure against the clamping of people, load and the like during the opening or closing of the slide door. In general, in the system for automatically opening or closing the slide door, there are often found such operations that the slide door 1 is moved from full opening to full closing or from full closing to full opening when a switch is turned on. Accordingly, when getting on or off is performed after the switch operation, there occur cases where people and load are clamped between the slide door 1 and the vehicle body 2 at the time of closing the slide door 1. Furthermore, when the slide door 1 is opened, there are cases where people and the like are clamped between an end of the slide door 1 and an external obstacle. It is essential for the system for automatically opening or closing the slide door to provide the safety countermeasure against the clamping.

In this case, it is the most important question that how the occurrence of clamping can be detected. For this, it is most efficient to provide a sensor for sensing the clamping on the slide door 1 itself. However, since it is known case by case that in what position the clamping has occurred, it cannot be clearly determined that at what position of the slide door 1 the sensor should be mounted. Furthermore, from the viewpoint of the layout of the vehicle, the slide door 1 is one which is an electrically separated equipment, so that it is necessary to add a special equipment for transmitting a detection signal from the sensor. Further, there are methods for physically sensing strain occurring in the slide door 1 and extension and the like of the wire 4 due to the clamping. However, all of these methods have problems regarding the position of mounting a strain gauge and noises thereof, so that it is substantially difficult to measure these. Then, in the conventional system for automatically opening or closing, by detecting a change in the number of rotation of the motor, which occurs due to the clamping, controls such as stopping, reverse rotation and so forth of the motor 9 have been performed on the basis of the change in the number of rotation.

Here, in the conventional system for automatically opening or closing, the change in the number of rotation of the motor 9 is measured in the following manner. Firstly, as shown in FIG. 9, a magnet 15 is disposed on the same shaft axis as an output shaft 9*a* of the motor 9, and a Hall element 16 is provided at a position close to the magnet 15. In this case, for example, 10 poles are magnetized in the magnet 15. That is, changes in the magnetic poles take place 10 times per rotation of the motor. Then, the change in the magnetic poles is seized as pulses by the Hall element 16, whereby the change in the number of rotation is measured due to the change in the interval of pulses. For example, when a man is clamped by the slide door 1, the wire 4 is stretched fully, whereby the load to the motor 9 is increased, the number of rotation is decreased and the motor 9 is stopped soon. At this time, the interval of the pulses emitted from the Hall element 16 is enlarged abruptly, whereby the change in the number of rotation is detected. When this change exceeds the change normally expectable as in the case where there has occurred the entrance into the curved portion 5*a* for example, i.e., when the number of rotation is changed abruptly, it is concluded that the clamping has occurred and the motor 9 is rotated reversely to dissolve the clamping.

Now, as a mechanism having a construction similar to the system for automatically opening or closing the slide door, there is found a power window system as shown in Patent Application Publication No. 32088/1971. This power window system is one, in which a window that is one of the opening-closing section of the vehicle is automatically opened or closed, and, for which it is naturally required that a safety countermeasure against the clamping is taken up.

Here, as shown in FIG. 10, a window pane 51 is secured to a wire 53 through a clamp 52, and this wire 53 is wound by a driving reel 55 which is driven by a motor 54, whereby the window pane 51 is moved up or down. In this case, if clamping occurs, then, a reel 56 is pulled downwardly, whereby a rocking rod 57 compresses a compression spring 58, and is rocked about a pin 59 in a counterclockwise direction. With this arrangement, a sensing microswitch 60 secured to the rocking rod 57 is moved toward a fixed rod 61, and the microswitch 60 is pressed by the fixed rod 61 to close a circuit for reversely rotating the motor 9, so that the clamping can be dissolved.

However, a conventional system for sensing a clamping like this presents such a problem that, firstly, with one, in which the clamping is sensed due to the change in the number of rotation of the motor, it takes long time before a change appears in the number of rotation of the motor from the time of occurrence of the clamping, whereby quite a long time lag occurs before the action of dissolving the clamping is started, and hence, the load applied to people who is clamped and the like is liable to exceed a standard aiming at less than 100N (FMWSS118).

Here, as shown in FIG. 11, the change in the number of rotation of the motor appears after transmitting the influence due to the clamping to a multiplicity of parts. That is, firstly, the clamping at the slide door 1 is transmitted to the slide rail 5 and the wire 4 through the center roller assembly 3 (S1–S4). Subsequently, as the wire 4 is wound up, the tensioners 11*a* and 11*b* are moved to remove the looseness of the wire 4 (S5), and finally, the wire 4 is stretched fully, whereby the load is transmitted to the drum 10 (S6). Then, the load, which was transmitted to this drum 10, is transmitted to the motor 9 through gears 14*a* to 14*d* (S7 and S8). With this arrangement, the clamping appears as a change in the number of rotation of the motor 9 for the first time, and the change is detected, whereby a command for reversely rotating the motor 9 is issued by the control unit 8 (S9).

As described above, according to the conventional system, stage of S1–S9 should be passed through before the motor 9 is reversely rotated from the time of occurrence of the clamping, whereby the time lag before the clamping becomes long. That is, various parts cause losses in the system of sensing the clamping, whereby response to the clamping is liable to be slow.

On the other hand, in the power window type system for sensing a clamping as shown in FIG. 10, the sensing microswitch 60 is operated in response to the movement of the tensioners 11*a* and 11*b* as shown in FIG. 9, so that the time lag can be lessened as compared with the above-described case. However, in the system for automatically opening or closing the slide door, the load is fluctuated depending upon the position of the slide door 1 due to the friction and the like of the curved portion 5*a*, whereby the positions of the tensioners 11*a* and 11*b* are changed. For this, there cannot be adopted a mechanism for sensing a clamping by an absolute value of a change in the position of the reel 56 as in the power window which is low in the load fluctuations. In this case, with the power window, unless there is an abnormal state such as a clamping, a change in the position of the reel 56 is small as compared with the case of the slide door, and, if the position of the reel 56 is changed and exceeds a value of change occurring during the transient state at the time of starting, then, it can be concluded that an abnormal state has occurred. Accordingly, in the power window, it is possible to determine the clamping using an absolute value by providing a predetermined threshold value in the value of change of the position of the reel 56.

In contrast to this, in the system for automatically opening or closing the slide door, there are no load fluctuations in the straight-lined portion 5*b* of the slide rail 5 and the positions of the tensioners 11*a* and 11*b* are not changed. However, when the center roller assembly 3 enters into the curved portion 5*a*, the positions of the tensioners 11*a* and 11*b* are changed. Accordingly, in the construction shown in FIG. 10, the load fluctuations at the curved portion 5*a* also concluded to be the clamping, so that the construction cannot counter the system which has the load fluctuations such as the slide door. In this case, it is possible that the change in the position due to the load fluctuations is expected, whereby the stroke of the rocking rod 57 is set at a large value, so that the change in the curved portion 5*a* is not concluded to be the clamping. However, if the stroke of the rocking rod 57 is set at a large value, then, more time is required for sensing the clamping, when it occurs actually, with the result that such a new problem that the sensing of the clamping is delayed is newly presented.

SUMMARY OF THE INVENTION

It is an object of the present invention to sense a clamping earlier and dissolve the clamping quickly in a system for automatically opening or closing for a vehicle.

The above-described and other objects and the novel feature of the present invention will be clarified by the description of the present specification and the accompanying drawings.

The following is the brief description of outlines of the typical ones out of the inventions disclosed in the present application.

That is, the system for automatically opening or closing for a vehicle according to the present invention, wherein the aforesaid system comprises: an opening-closing section openably provided on a vehicle body; a drum for winding a wire solidly secured to the opening-closing section; and a motor for driving the drum; and the wire is wound by the drum, whereby the opening-closing section is automatically opened or closed, is characterized in that the aforesaid system further comprises: tensioners provided between the drum and the opening-closing section, for maintaining the tensile force of the wire within a predetermined range by removing the looseness of the wire due to its movement; moving speed detecting means for detecting moving speeds of the tensioners; and a control means for concluding occurrence of a clamping due to opening or closing of the opening-closing section and dissolving the clamping when the detected moving speeds of the tensioners are larger than a value preset in advance in cases other than the full closing or the full opening of the opening-closing section.

Preferably, said moving speed detecting means comprises plate members synchronously moving with said tensioners and magnetic sensors for detecting the movement of said plate members. In this case, pulser coils can be used as said magnetic sensors.

Still preferably, said moving speed detecting means comprises plate members synchronously moving with said tensioners and optical sensors for detecting the movement of said plate members. Preferably, said optical sensors comprise light emitting means and light receiving means for receiving the light emitted from said light emitting means in this case.

Preferably and additionally, said control means concludes the occurrence of clamping by recognizing the position of said opening-closing section in addition to the movement of said tensioners.

Then, preferably, said opening-closing section is a slide door or a sun-roof of the vehicle.

DESCRIPTION OF THE PREFERRED EMBODIMENTS

Detailed description will hereunder be given of the embodiments of the present invention with reference to the drawings.

Figure 1:
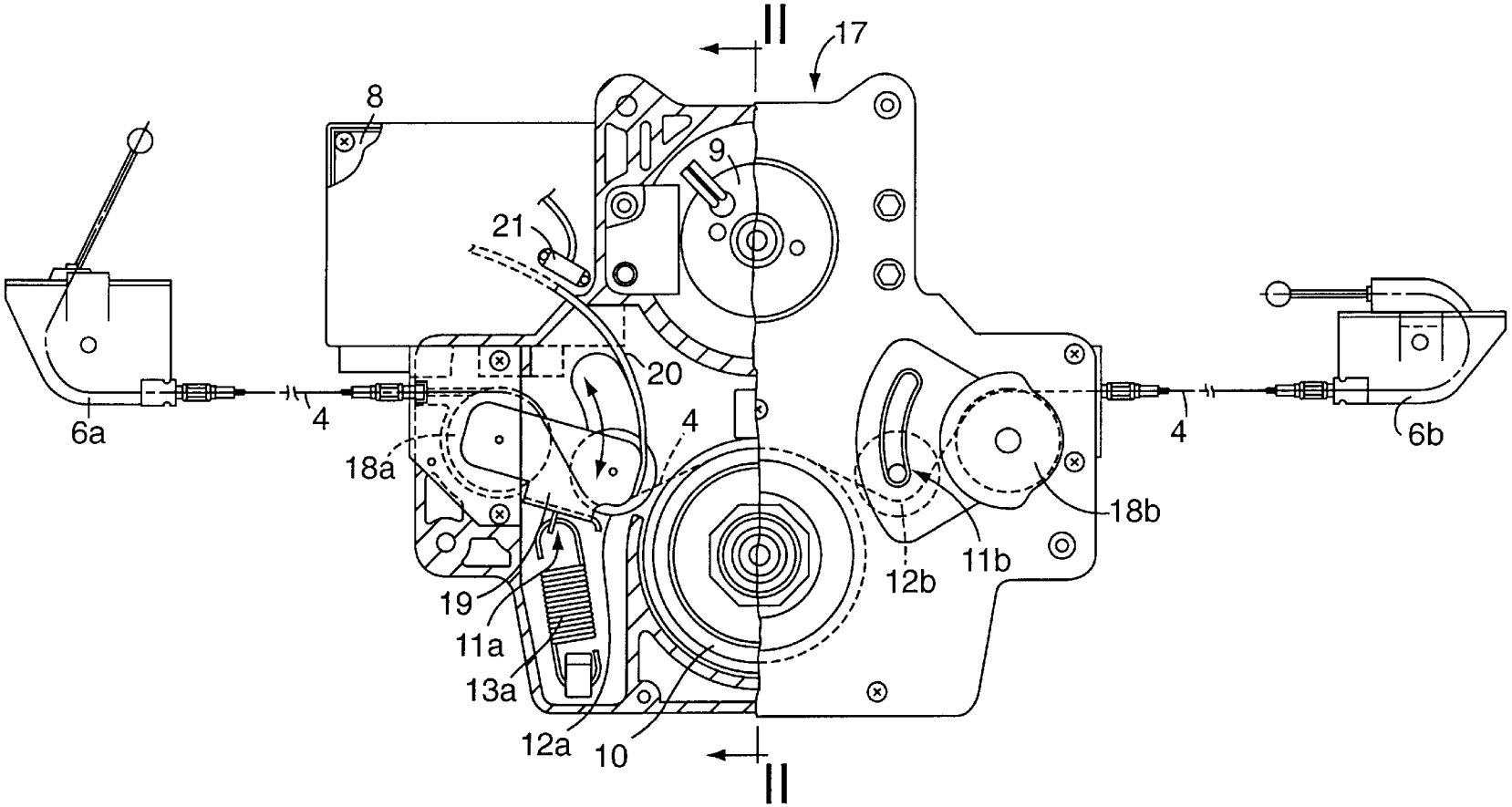
FIG. 1 is an explanatory view showing the construction of a slide actuator used in the system for automatically opening or closing a slide door, which is an embodiment 1 of the present invention.
Figure 2:
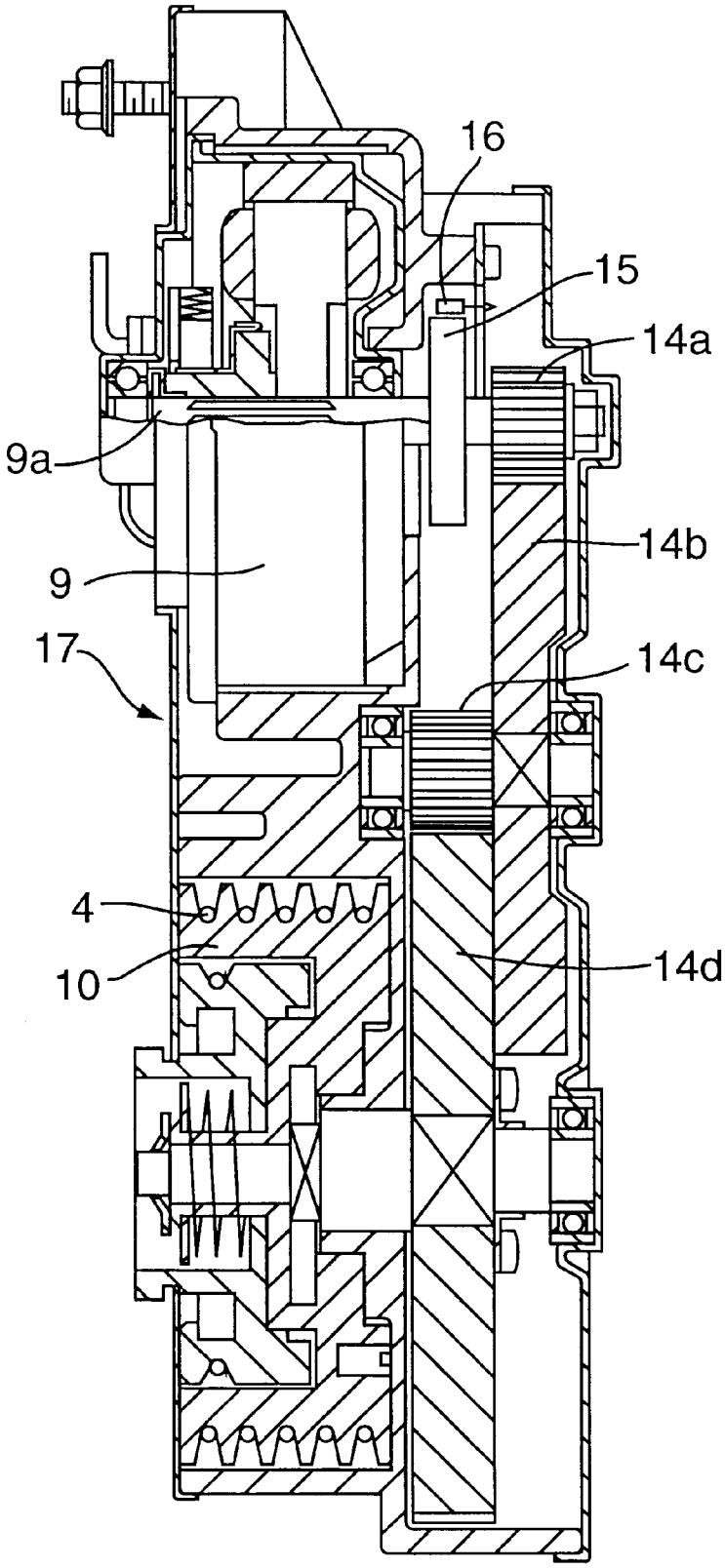
FIG. 2 is a sectional view taken along the line II—II of the slide actuator shown in FIG. 1.

FIG. 1 is the explanatory view showing the construction of a slide actuator 17 used in the system for automatically opening or closing the slide door with a part thereof being shown in cross-section. Furthermore, FIG. 2 is the sectional view taken along the line II—II of the slide actuator 17 shown in FIG. 1.

Figure 8:
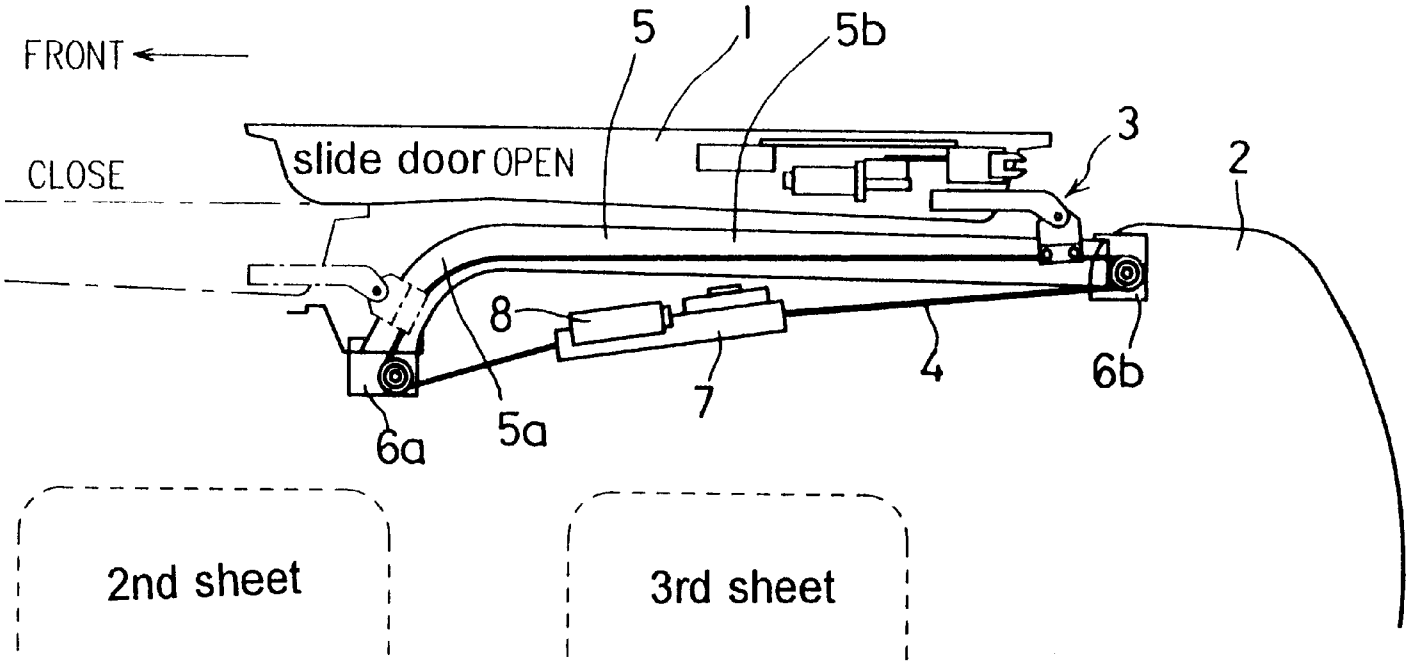
FIG. 8 is an explanatory view showing the construction of the conventional system for automatically opening or closing the slide door.
Figure 9:
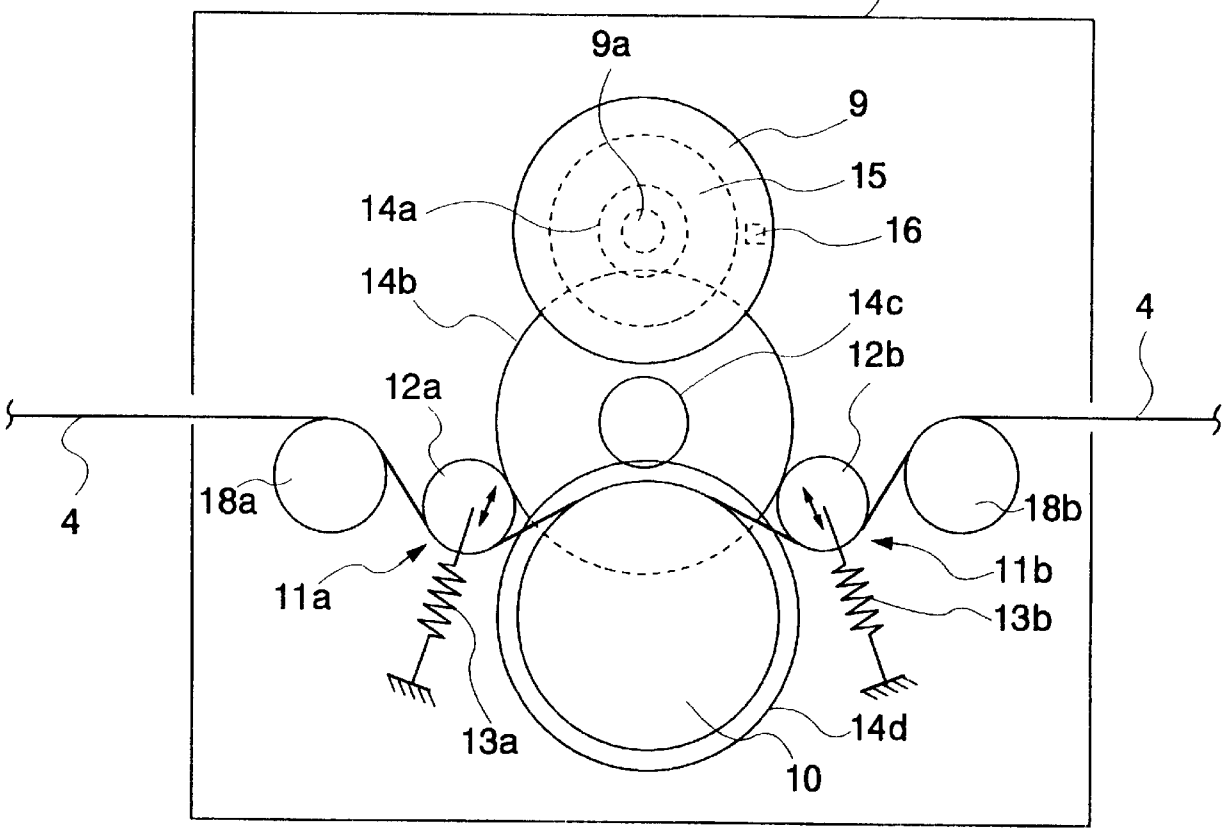
Fig. 9 (PRIOR ART)
FIG. 9 is an explanatory view showing the outline of the construction of the slide actuator used in the system for automatically opening or closing as shown in FIG. 8.
Figure 10:
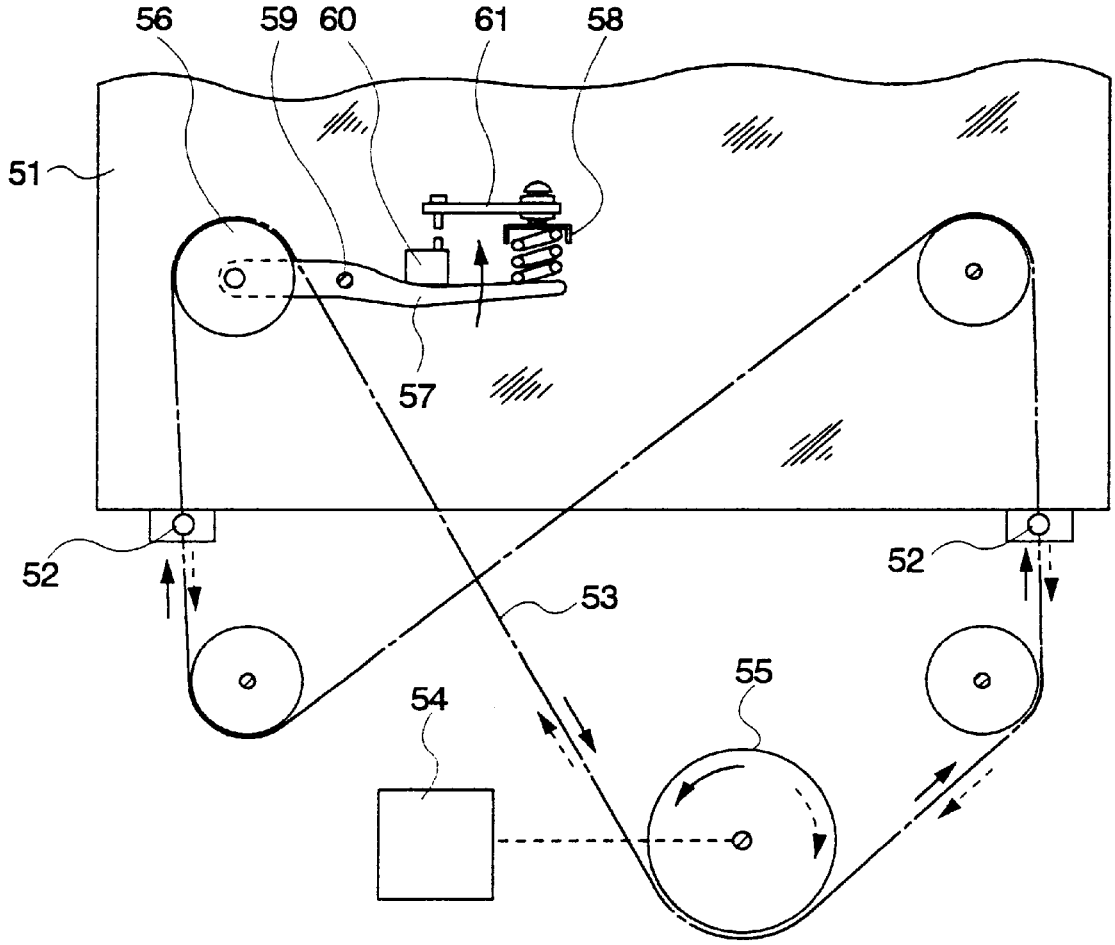
FIG. 10 is an explanatory view showing the outline of the construction of the power window type system for automatically opening or closing.

Similarly to the slide actuator 7 shown in FIG. 8, the slide actuator 17 shown in this embodiment 1 is provided on a vehicle body 2 as a system for automatically opening or closing a slide door (opening-closing section) 1. That is, this slide actuator 17 is operated, whereby the wire 4 guided by the slide actuator 17 is moved through the pulley assembly 6*a* and 6*b*. Then, with this arrangement, the slide door 1 solidly connected to the wire 4 by the center roller assembly 3 is longitudinally moved along the side of the vehicle body 2 under the guidance of the slide rail 5. The construction thereof is identical with one shown in FIG. 8 except for the slide actuator 17, so that the detailed description will be omitted.

Here, similarly to the above-described slide actuator 7, the slide actuator 17 includes the drum 10 connected to the motor 9 through the gears 14*a*–14*d*, whereby the wire 4 is wound. Then, by the normal or reverse rotation of this motor 9, the rotating direction of the drum 10, i.e., the pull-in direction of the wire 4 is determined, whereby the moving direction of the slide door 1 is determined. Furthermore, the magnet 15, in which 10 poles are magnetized with S poles and N poles being alternately arranged, is secured onto the output shaft 9*a* of the motor 9, and by the Hall element 16 provided close to the magnet 15, the number of rotation of the output shaft 9*a* can be detected.

On the other hand, this slide actuator 17 is also provided with the tensioners 11*a* and 11*b*, respectively, in front of the drum 10, for removing the looseness of the wire 4 and adjusting the feed rate of the wire 4. Here, the tensioner 11*a* comprises the fixed pulley 18*a*, the moving pulley 12*a* provided between this fixed pulley 18*a* and the drum 10 and a tension arm 19 for movably holding the moving pulley 12*a* in a direction indicated by arrows. In this case, the tension arm 19 is mounted movably about a center shaft of the fixed pulley 18*a* and brought into a state of being pulled downwardly in the drawing by the tension spring 13*a*. Then, the wire 4 starts from the pulley assembly 6*a*, reaches the fixed pulley 18*a*, is guided around the moving pulley 12*a*, and thereafter, wound by the drum 10. With this arrangement, when the moving pulley 12*a* is pulled by the tension spring 13*a* to be moved downwardly, the path, through which the wire 4 is pulled around, is lengthened. Accordingly, while the slide door 1 is moved on the straight-lined portion 5*b* of the slide rail 5, the moving pulley 12*a* is lowered to remove the looseness of the wire 4, and, when the slide door 1 enters the curved portion 5*a*, the moving pulley 12*a* is raised to make the path of the wire 4 straight-lined, so that the value of the wire 4 required during the passage of the curved portion 5*a* can be compensated. In the right inner side in the drawing also, the tensioner 11*b* having the same construction as the tensioner 11*a* is provided, and the moving pulley 12*b*, the fixed pulley 18*b* and the like are provided in the same manner as described above.

Figure 3:
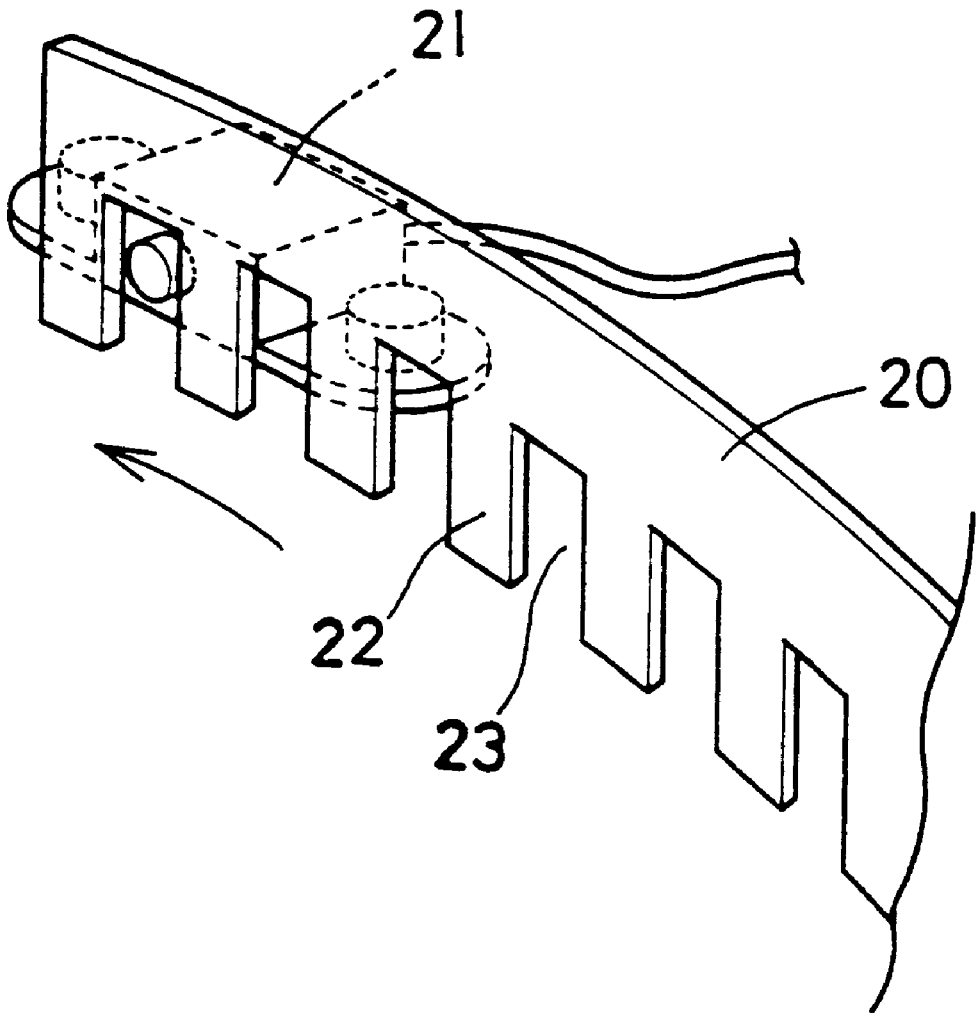
FIG. 3 is an oblique view showing states of a sensor plate and a magnetic sensor.

Now, the slide actuator 17 is provided with a sensor plate 20 and a magnetic sensor 21, which are formed of a magnetic material such as iron, as a moving speed detecting means for detecting a moving speed of the tensioner 11*a*. FIG. 3 shows states of the sensor plate 20 and he magnetic sensor 21. In this case, the sensor plate 20 is formed integrally on the tension arm 19, whereby the sensor plate 20 is moved together with the moving pulley 12*a*. Furthermore, the magnetic sensor 21 is disposed at the side of the forward end portion of the sensor plate 20, being faced to the sensor plate 20, whereby the passage of the sensor plate 20 as being a magnetic material can be sensed. In the embodiment 1, a pulser coil used in an AC generator is supposed to be used as the magnetic sensor 21. However, as far as the sensor can discriminate the presence of the magnetic material which is opposed thereto, any other types of sensors may be used and the type are not limited to the above-described one.

Here, as shown in FIG. 3, the lower portion of the sensor plate 20 is serrated and a serrated portion passes by the front of the magnetic sensor 21. That is, when the sensor plate 20 is moved in a direction indicated by an arrow along with the operation of the tensioner 11*a*, magnetic material portions 22 and spaces 23 pass by the front of the magnetic sensor alternately. Incidentally, a width of the magnetic material portion 22 and a width of the space 23 are determined to be a predetermined width, respectively, as 10 mm for example. Furthermore, the serrated portion of the sensor plate 20 is opposed to the magnetic sensor 21 over the whole area of moving range of the tensioner 11*a*. Accordingly, the movement of the sensor plate 20, i.e., the tensioner 11*a* can be grasped over the whole area of movable range.

On the other hand, the magnetic sensor 21 has a function like a differentiation circuit, and, when a magnetic circuit is formed by the passage of the magnetic material potion 22, whereby a magnetic coupling becomes dense, a pulse on the plus side is emitted, for example. Furthermore, when the magnetic material portion 22 passes and the space 23 passes, whereby the magnetic coupling becomes coarse, a pulse on the minus side is emitted for example. That is, pulses are emitted along with the movement of the sensor plate 20, when the movement of the sensor plate 20 is fast, intervals of the pulses emitted from the magnetic sensor 21 become short, and, when the movement of the sensor plate 20 is slow, the intervals of the pulses become long. Then, these pulses are sent to the control unit (control means) 8, whereby the movement of the tensioner 11*a* is analyzed, so that the moving speed of the sensor plate 20 can be detected. As described above, in the slide actuator 17, the sensor plate 20, which is operated in synchronism with the tensioner 11*a*, is provided and the movement thereof is detected by the magnetic sensor 21, so that the movement of the tensioner 11*a* can be grasped.

Incidentally, FIG. 1 shows the sensor plate 20 formed integrally on the tension arm 19. However, it is needless to say that the both members may be formed separately from each other, and thereafter, may be integrated by use of a fastening means such as a screw, a rivet and the like. Furthermore, although it is not shown in FIG. 1, the tensioner 11*b* shown in FIG. 1 is also provided with a sensor plate, the movement of which is monitored by a magnetic sensor similarly to the tensioner 11*a*, whereby the clamping during the opening of the slide door 1 is countered. Accordingly, not only in the case of the clamping during the closing of the door, also in the case where the end portion of the slide door 1 collides against an external obstacle during the opening of the door or a man and the like are clamped therebetween, the trouble can be quickly dissolved.

Next, description will be given of the action of the slide actuator 17. Since the normal opening or closing action is identical with the conventional system for automatically opening or closing, the detailed description will be omitted, and only the action during the occurrence of the clamping will be described.

Here, it is supposed that, when the slide door 1 is closed, a man is clamped between the slide door 1 and the vehicle body 2. At this time, the movement of the slide door 1 is disturbed by the man. However, the motor 9 still rotates the drum 10 to continue to wind the wire 4. For this, the wire 4 on the side of winding is stretched, and accordingly, the moving pulley 12*a* is moved upwardly against the resilient force of the tension spring 13*a*. In this case, the moving pulley 12*a* is quickly moved upwardly as differed from the transient action immediately after the operation of the drum 10. Accordingly, the sensor plate 20 together with the moving pulley 12*a* moves quickly, and passes by the front of the magnetic sensor 21 at a speed quicker than the usual speed. At this time, pulses denser than the normal ones are emitted from the magnetic sensor 21 and sent to the control unit 8. Upon receiving these pulses, the control unit 8 calculates the moving speed of the tensioner 11*a* based on the thus sent pulses, and compares it with a predetermined threshold value (predetermined value) which is preset in advance in the control unit 8. This threshold value is the upper limit value in the range of the moving speed of the tensioner 11*a* in a case where the slide door 1 normally performs the opening-closing operation. Then, when the speed of the tensioner 11*a* exceeds the threshold value, a possibility that an abnormal state has occurred in the operation of the slide door 1 is recognized.

On the other hand, the moving speed of the tensioner 11*a* can be recognized by the time of passing of the magnetic material portion 22. In this case, the time of passing of the magnetic material portion 22 is supposed to be 10 ms or thereabove, for example, during the normal opening-closing operation, this 10 ms becomes the threshold value and is compared with the moving speed of the tensioner 11*a* at present. Then, for example, when it is detected that the magnetic material portion 22 passed at 1 ms, it is determined that the speed of the tensioner 11*a* exceeds the threshold value and a possibility that an abnormal state has occurred in the operation of the slide door 1 is recognized.

Now, when the slide door 1 is fully closed without the clamping, the tensioner 11*a* shows the movement similar to the clamping. That is, even when the slide door 1 is fully closed, the tensioner 11*a* is quickly moved upwardly before the stoppage of the operation of the motor 9. As a phenomenon, this is similar to one during the clamping, and it is difficult to discriminate these from each other only when the movement of the tensioner 11*a* is observed.

Then, in the slide actuator 17, these phenomena are discriminated from each other by simultaneously detecting the position of the slide door 1. Here, the motor 9 is provided with the magnet 15 as described above, and the number of rotation of the motor 9 is grasped as pulses by the magnet 15 and the Hall element 16. For this, when the slide door 1 is normally opened or closed in a state of no clamping, the number of rotation of the motor 9 during the whole process can be converted into the number of pulses. That is, the process of the slide door 1 can be grasped in advance, for example, as 1000 pulses during the whole process of the closing operation, and by counting the number of pulses, the position of the slide door 1 at present can be found.

The control unit 8 performs even this detection of the slide door by this pulse count, and, the slide actuator 17 recognizes the position of the slide door 1 in addition to the movement of the tensioner 11*a* and concludes the occurrence of clamping. That is, before the closing operation, a predetermined number of pulses (1000 pulses in the aforesaid example) is preset in advance, and this predetermined number of pulses is discounted by the pulses from the Hall element 16. Then, when the remaining number becomes zero and the tensioner 11*a* has moved at a speed exceeding the predetermined value, it is concluded that the slide door 1 is closed in the normal state. On the other hand, when the tensioner 11*a* has moved at the speed exceeding the predetermined value before the remaining number becomes zero, it is concluded that the clamping has occurred, and a command is issued at once to the motor 9, whereby the drum 10 is reversely rotated to dissolve the clamping.

As described above, in the slide actuator 17, it is concluded that the clamping has occurred on two conditions that the slide door 1 is not fully closed or fully opened and that an abnormal movement of the tensioner 11*a* is detected. With this arrangement, the detection of the clamping , which has been difficult to conclude only by the movement of the tensioner 11*a*, can be performed quickly and positively.

Figure 4:
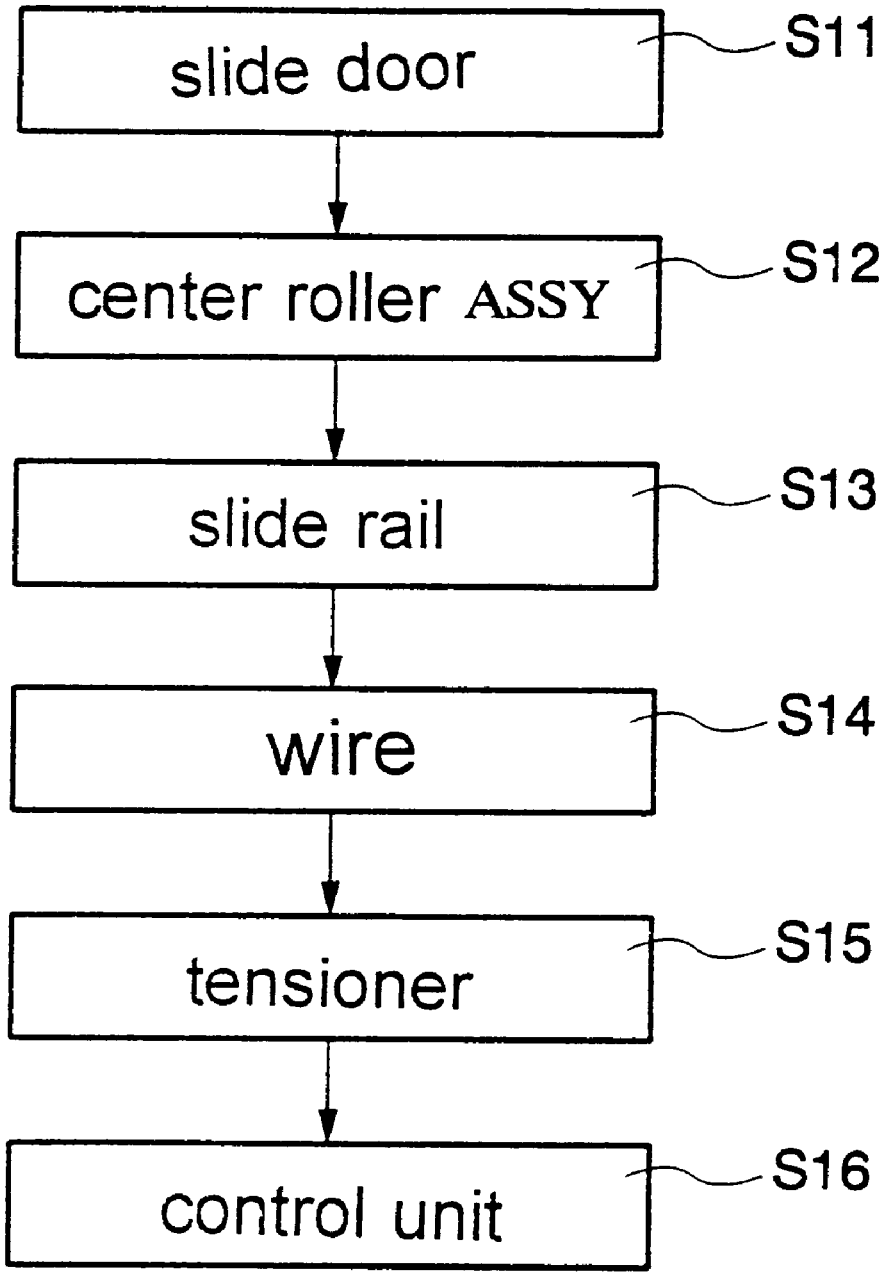
FIG. 4 is an explanatory view showing a path, through which the influence of a clamping is transmitted when the clamping occurs in the system for automatically opening or closing a slide door according to the present invention.
Figure 11:
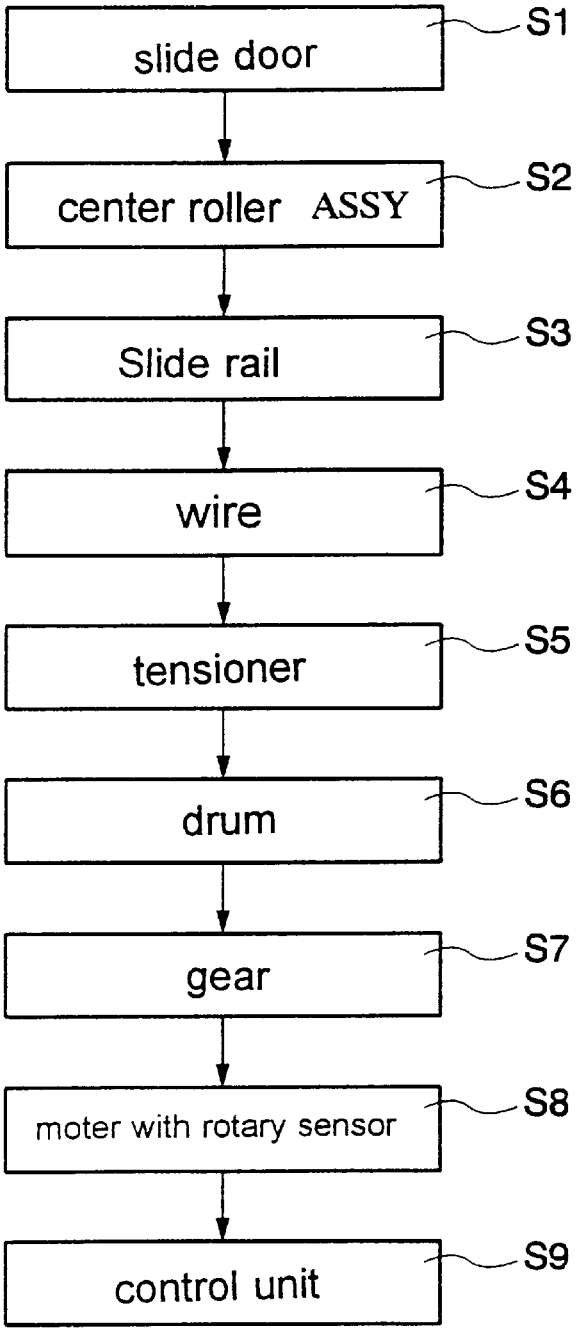
FIG. 11 is an explanatory view showing the path, through which the influence of the clamping is transmitted in a case where the clamping occurs in the conventional system for automatically opening or closing the slide door.

On the other hand, a change in the number of rotation of the motor appears after the tensioner 11*a* is moved upwardly. Accordingly, the system for automatically opening or closing according to the present invention is capable of taking the countermeasure against the clamping at an earlier stage than that the clamping is countered only after this change in the number of rotation of the motor 9. FIG. 4 is the explanatory view showing the path, through which the influence of the clamping is transmitted during the clamping in the system for automatically opening or closing the slide door according to the present invention. Here, the clamping is detected during six steps of S11 to S16, as apparent from the comparison with FIG. 11, it is found that the path of S6–S8 as shown in FIG. 4 is shortened, so that the quick countermeasure can be taken.

Figure 5:
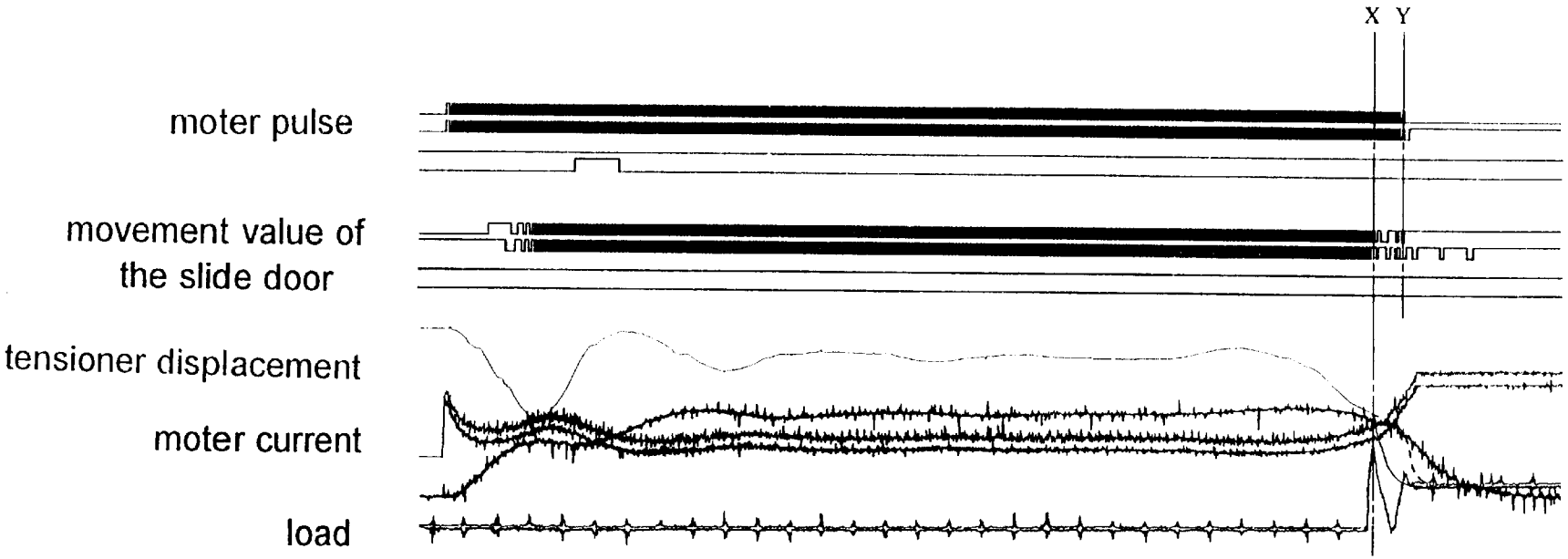
FIG. 5 is a graphic chart of measuring displacements of tensioners when the slide door is closed.

In order to substantiate the effects of the invention, the inventors of the present invention measured the movement of the tensioner 11*a* in the system for automatically opening or closing the slide door. FIG. 5 shows the result, in which the position of the tensioner 11*a* in a case where the slide door 1 is closed is shown together with the pulses showing the number of rotation of the motor. The position of the tensioner 11*a* was measured by a laser displacement meter.

As shown in FIG. 5, as the load is increased due to the occurrence of the clamping, the tensioner 11*a* is abruptly displaced at a time X. In this case, no change in the motor pulses is observed at the time X. Subsequently, as the tensioner 11*a* is displaced, the load is lowered once accordingly, and the load is increased again when the wire 4 is fully stretched. Then, at this time, the load due to the clamping is applied to the motor 9 for the first time, whereby a change takes place in the motor pulses (time Y). As described above, in the conventional system for automatically opening or closing, the occurrence of the clamping is detected at this time Y. In contrast thereto, in the system for automatically opening or closing according to the present invention, the occurrence of the clamping is detected at the time X. In view of FIG. 5, the difference in time between the both system is clear.

Incidentally, the reason why the tensioner 11*a* is displaced before the time X resides in that the center roller assembly 3 enters the curved portion 5*a*, whereby the load is increased accordingly. Furthermore, in the case where the clamping does not occur, the tensioner 11*a* is displaced in a manner as indicated by a broken line.

Figure 6:
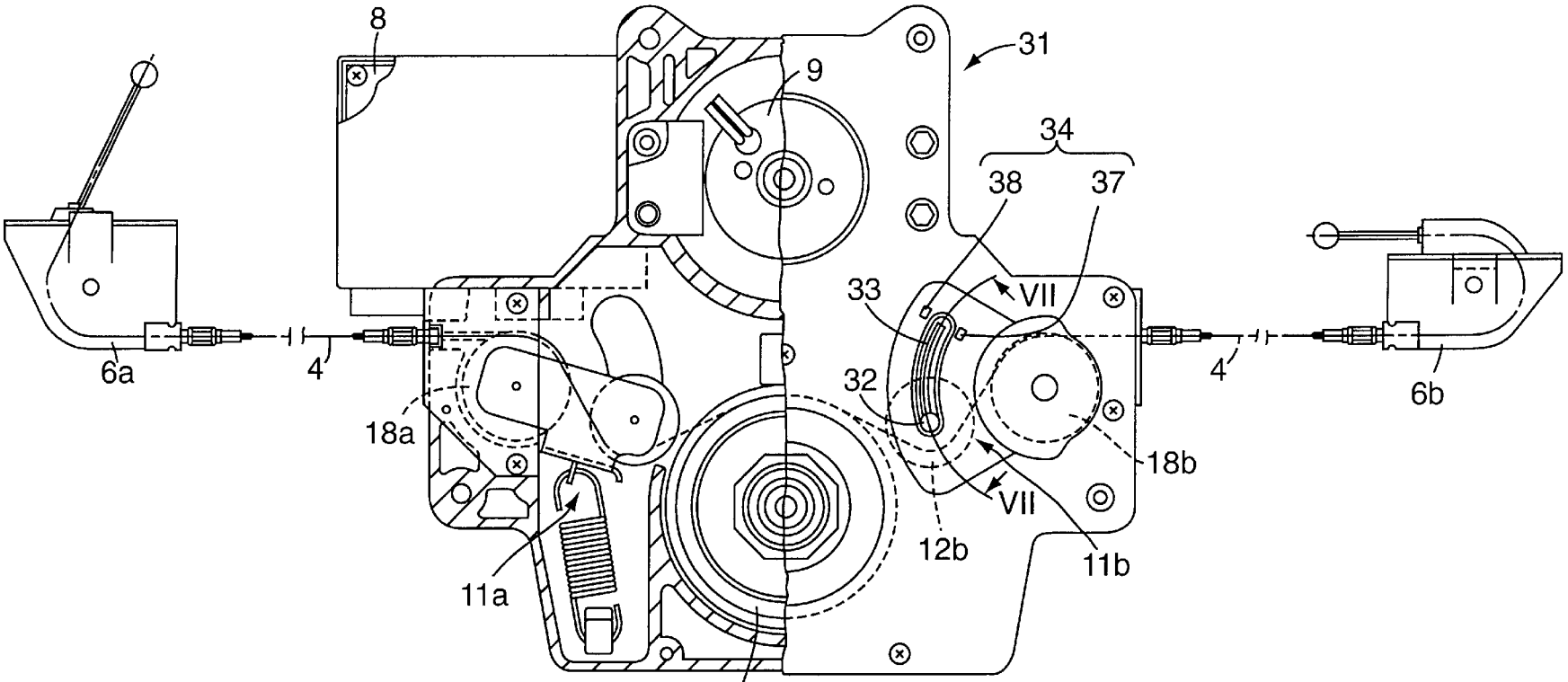
FIG. 6 is an explanatory view showing the construction of the slide actuator used in the system for automatically opening or closing the slide door in another embodiment 2 of the present invention.
Figure 7:
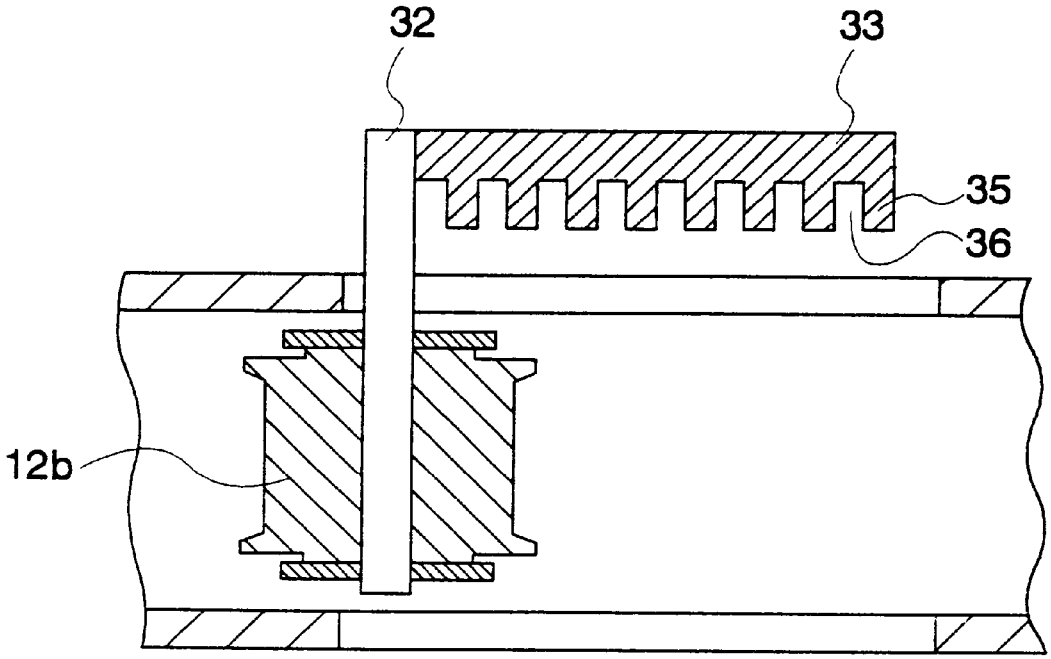
FIG. 7 is a sectional view taken along the line VII—VII in FIG. 6.

FIG. 6 is the explanatory view showing the construction of a slide actuator 31 used in the system for automatically opening or closing the slide door in the embodiment 2 of the present invention, with a part being sectioned. Furthermore, FIG. 7 is the sectional view taken along the line VII—VII of the slide actuator 31 shown in FIG. 6. The whole construction of the system for automatically opening or closing is similar to one shown in FIG. 8. As for the slide actuator 31, since it has a construction substantially identical with the embodiment 1, the same reference numerals are attached to the same component members, and the details will be omitted.

Here, in the slide actuator 31 shown in FIG. 6, a sensor plate 33 is mounted on a pulley shaft 32 of the moving pulley 12*b*, and the movement thereof is sensed by an optical unit 34, whereby the movement of the tensioner 11*b* can be sensed. That is, in the embodiment 2 , the clamping is sensed by use of a moving speed detecting means formed of an optical mechanism. In this case, as shown in FIG. 7, the sensor plate 33 has a same shape as the sensor plate 20 in the embodiment 1, and light shielding portions 35 and spaces 36 are formed in the lower part thereof. On the other hand, the optical unit 34 includes a light emitting potion 37 having a light emitting element such as an emission diode and a light receiving portion 38 having a light receiving element for outputting an electric signal by light such as photo-transistor and a photo-diode. The sensor plate 33 passes between the light emitting portion 37 and the light receiving portion 38. It is needless to say that the same construction as this is provided on the side of the tensioner 11*a*.

In this case, when the space 36 passes between the light emitting portion 37 and the light receiving portion 38, a beam from the light emitting portion 37 is received by the light receiving portion 38, whereby a signal is output and sent to the control unit 8. On the other hand, when the light shielding portion 35 passes, the beam is shielded, whereby no signal is output from the light receiving portion 38. Accordingly, as the sensor plate 33 is moved, the lights shielding potion 35 and the spaces 36 alternately pass between the light emitting portion 37 and the light receiving portion 38, whereby the pulse-shaped signals are sent to the control unit 8 intermittently. With this arrangement, the width of the signal, which has been sent, is detected, whereby the moving speed of the sensor plate 33, i.e., the tensioner 11*b* is detected. Then, similarly to the embodiment 1, when anything abnormal is found in the movement of the sensor plate 33, the presence of the clamping is concluded considering the position of the slide door 1. Since this procedure and the like are similar to those described above, the details will be omitted.

As described above, also, in the system for automatically opening or closing as shown in the embodiment 2, the clamping is sensed at an earlier stage than the stage in the past by detecting the moving speed of the tensioner 11*b*, so that the clamping can be dissolved earlier. It is needless to say that the similar construction is provided on the side of the tensioner 11*a*. Furthermore, similarly to the embodiment 1, as a method of mounting the sensor plate 33, various methods such as screwing and welding can be adopted.

Detailed description has been given of the invention made by the inventors of the present invention with reference to the embodiments. However, it is needless to say that the invention is not limited to the above-described embodiments and can be variously modified within the scope not departing from the technical gist.

For example, there are shown such examples that, in the embodiment 1, the sensor plate 20 and the magnetic sensor 21 are used for detecting the moving speeds of the tensioners 11*a* and 11*b*, and, in the embodiment 2, the sensor plate 33 and the optical unit 34 are used. However, the moving speed detecting means should not necessarily be limited to these examples. That is, as shown in an experimental example shown in FIG. 5, detection may be made by use of the displacement measuring means such as the laser displacement meter, and, a disc and a magnet, which are rotatable in synchronism with the tension arm 19, are provided, whereby the rotations are detected, so that the moving speeds of the tensioners 11*a* and 11*b* may be sought. In this case, it is needless to say that there may be used a combination of the magnetic sensor and the optical unit with a disc, in which the magnetic material portion, and light shielding portions and spaces, which are alternately arranged, are provided. The magnet and the Hall element may be combined.

Furthermore, in the embodiment 1, the magnetic sensor 21 is provided such that the sensor plate 20 comes in front of the magnetic sensor 21 even when the moving pulley 12*a* is positioned at the bottom end. However, the position of the magnetic sensor 21 is not limited to this. That is, an end portion of the sensor plate 20 may just approach the magnetic sensor 21 when the moving pulley 12*a* is positioned at the bottom end, and the sensor plate 20 may pass by the front of the magnetic sensor 21 from a midway of the moving stroke. However, in the latter case, such a condition is imposed that the range, within which sensing of a clamping can be made, shall be secured. This is similar to the embodiment 2, and the disposition of the optical unit 34 is not limited to the position shown in FIG. 6.

The above description has been mainly given of the case, in which the invention made by the inventors of the present invention is applied to the slide door in the field of utilization of the invention. However, the invention is not limited to this, and applicable to other opening-closing sections provided on vehicles such as vehicles having electrically movable sun-roofs.

The following is brief description of the effects obtained by typical ones out of the inventions disclosed in the present specification.

That is, there is such an effect that, by detecting the moving speeds of the tensioners, the clamping can be sensed at an earlier stage than in the conventional case where the clamping was sensed by changes in the seed of the rotation of the motor. Accordingly, the operation of dissolving the clamping can be performed earlier and the safety against the clamping can be improved.

What is claimed is:

1. A system for automatically opening or closing an opening-closing section for a vehicle, wherein said system comprises:

an opening-closing section adapted for a vehicle body and adapted to be movable between open and closed positions relative to the vehicle body;

a drum for winding a wire solidly secured to said opening-closing section;

a motor for driving said drum, said wire being wound by said drum so that said opening-closing section is opened and closed by the operation of the motor;

two tensioners through each of which said wire passes, said tensioners being located on opposite sides of said drum and between said drum and said opening-closing section, for maintaining the tensile force of said wire within a predetermined range by removing the looseness of said wire due to its movement, at least one of said tensioners further having a tension arm pivotable about a fixed pivot of the tensioner, the pivoted position of which is dependent on the tensile force in the wire as it passes through the tensioner;

moving speed detecting means including a sensor plate coupled to the pivotable tension arm and a fixed sensor opposing the sensor plate for detecting the moving speeds of said movable parts of the at least one of said tensioners;

position detecting means adapted to detect the position of said opening-closing section relative to the vehicle body; and a control means for determining, in response to said moving speed detecting means, the occurrence of a sudden increase in the tension force of said wire to a value above said predetermined range during the opening or closing of the opening-closing section and for relieving said increased tension force if at the time of said sudden increased tension force determination the position detecting means detects that said opening-closing section is at a position other than said open or closed position.

2. A system for automatically opening or closing an opening-closing section for a vehicle as set forth in claim 1, wherein said sensor plate is movable synchronously with said tension arm of said at least one tensioner, and said sensor is a magnetic sensor for detecting the movement of said at least one sensor plate.

3. A system for automatically opening or closing an opening-closing section for a vehicle as set forth in claim 2, wherein said magnetic sensor is a pulser coil.

4. A system for automatically opening or closing an opening-closing section for a vehicle as set forth in claim 1, wherein said sensor plate is movable synchronously with said tension arm of said at least one tensioner, and said sensor is an optical sensor for detecting the movement of said at least one sensor plate.

5. A system for automatically opening or closing an opening-closing section for a vehicle as set forth in claim 4, wherein said optical sensor includes light emitting means and light receiving means for receiving the light emitted from said light emitting means.

6. A system for automatically opening or closing an opening-closing section for a vehicle as set forth in claim 1, wherein said position detecting means detects the position of said opening-closing section based on the rotation frequency of said motor.

7. A system for automatically opening or closing an opening-closing section for a vehicle as set forth in claim 6, Wherein said position detecting means comprises a magnet secured onto an output shaft of said motor and a Hall element for detecting the rotation of said magnet and outputting pulses, and said position detecting means detects the rotation frequency of said motor by counting said pulses.

8. A system for automatically opening or closing an opening-closing section in combination with a vehicle, said system comprising:

an opening-closing section including a sliding door provided on a vehicle body and movable between open and closed positions relative to the vehicle body;

a drum for winding a wire solidly secured to said opening-closing section;

a motor for driving said drum, said wire being wound by said drum so that said opening-closing section is opened and closed by the operation of the motor;

two tensioners through each of which said wire passes, said tensioners being located on opposite sides of said drum and between said drum and said opening-closing section, for maintaining the tensile force of said wire within a predetermined range by removing the looseness of said wire due to its movement, at least one of said tensioners further having a tension arm pivotable about a fixed pivot of the tensioner, the pivoted position of which is dependent on the tensile force in the wire as it passes through the tensioner;

moving speed detecting means including a sensor plate coupled to the pivotable tension arm and a fixed sensor opposing the sensor plate for detecting the moving speeds of said movable parts of the at least one of said tensioners;

position detecting means for detecting the position of said opening-closing section relative to the vehicle body; and a control means for determining, in response to said moving speed detecting means, the occurrence of a sudden increase in the tension force of said wire to a value above said predetermined range during the opening or closing of the opening-closing section and for relieving said increased tension force if at the time of said sudden increased tension force determination the position detecting means detects that said opening-closing section is at a position other than said open or closed position.

* * * * *